United States Patent [19]

Kennedy et al.

[11] Patent Number: 4,643,695

[45] Date of Patent: Feb. 17, 1987

[54] TOY WORK VEHICLE HAVING POWER TAKE-OFF

[75] Inventors: Melvin R. Kennedy, New York, N.Y.; Dietmar Nagel, Chester, N.J.; Abraham A. Arad, Westport, Conn.

[73] Assignee: Buddy L Corporation, New York, N.Y.

[21] Appl. No.: 764,735

[22] Filed: Aug. 12, 1985

Related U.S. Application Data

[62] Division of Ser. No. 651,714, Sep. 18, 1984, Pat. No. 4,565,438.

[51] Int. Cl.[4] ..... A63H 17/12

[52] U.S. Cl. ..... 446/427; 180/53.7; 180/65.7

[58] Field of Search ..... 446/424, 425–428, 446/442, 443, 448, 449, 454, 457, 462–464, 484, 485; 180/53.1, 53.7, 65.1, 65.7

[56] References Cited

U.S. PATENT DOCUMENTS

| | | | |
|---|---|---|---|
| 3,475,854 | 11/1969 | Ryan et al. | 446/427 |
| 4,467,557 | 8/1984 | Kuna et al. | 446/463 |
| 4,479,327 | 10/1984 | Wakimura | 446/462 |
| 4,553,947 | 11/1985 | Weiland et al. | 446/443 |
| 4,560,022 | 12/1985 | Kassai | 180/65.1 |

FOREIGN PATENT DOCUMENTS

| | | | |
|---|---|---|---|
| 2092969 | 8/1982 | United Kingdom | 180/65.1 |

*Primary Examiner*—F. Barry Shay
*Attorney, Agent, or Firm*—Michael Ebert

[57] ABSTRACT

A toy work vehicle propelled by a bi-directional d-c motor in a forward or reverse direction depending on the polarity of battery voltage applied thereto, the vehicle including a power take-off device driven by the same motor to raise or lower a load. A gear shift mechanism operatively coupled either to the wheel axles or to the power take-off device, is controlled by a shift stick which in neutral operatively couples the motor only to the power take-off device. The shift stick is movable to a lateral position having a forward and a reverse mode in which the motor is operatively coupled to the wheel axles. The shift stick also cooperates with a slide carrying the movable contacts of a polarity-reversing switch connecting the battery to the motor such that when the stick is in neutral the motor is disconnected; when the stick is in the forward mode, the battery voltage is applied in a polarity causing forward motion of the wheels; and when the stick is in the reverse mode, the polarity is reversed to cause reverse wheel motion. Coacting with the switch slide is a power take-off lever having a forward and back position such that when the shift stick is in neutral and the lever is in its forward mode, this causes the motor to drive the power take-off device to raise the load, and when the shift stick is in neutral and the lever is in its back mode, this causes the device to lower the load.

4 Claims, 11 Drawing Figures

TOY WORK VEHICLE HAVING POWER TAKE-OFF

RELATED APPLICATIONS

This application is a division of our pending application Ser. No. 651,714, filed Sept. 18, 1984 having the same title (now U.S. Pat. No. 4,565,538).

BACKGROUND OF INVENTION

1. Field of Invention

This invention relates generally to electrically-powered toy vehicles, and more particularly to a toy work vehicle propelled by a bi-directional d-c motor in either the forward or reverse direction, the vehicle including a power take-off device driven by the same motor.

The most effective toys in terms of play value and sustained interest on the part of the player are those that simulate real-life adult activity. Thus a toy vehicle is more attractive to a child if it has the appearance of a familiar full-scale, adult vehicle. The toy vehicle is even more appealing to the child if the vehicle performs and can be operated in a manner comparable to the adult version, for then the child can play-act the role of an adult.

Of particular interest to children are work vehicles having a four-wheel drive and provided with tractor-type wheels, making it possible for the vehicle to travel over rough terrain and therefore reach difficult sites not accessible to ordinary vehicles. Such work vehicles are provided with a power take-off device such as a winch to wind or unwind a cable having a load-carrying hook at its end, or a crane to hoist loads. Thus a work vehicle is impressive to a child, for it is not only capable of traveling over rough terrain as well as ordinary paved roads, but it can exploit its motor to carry out heavy tasks.

In the case of a standard work vehicle having an internal combustion engine, in order for the engine to selectively drive either the wheels or the power take-off device, an elaborate gear shift mechanism is required for this purpose. But in a toy work vehicle driven by a bi-directional d-c motor, the type of gear mechanism which is appropriate to an internal combustion engine is clearly unsuitable in that forward and reverse motion is effected, not by the gear mechanism, but by the polarity of voltage applied to the motor.

Yet in order to emulate the activity of a real-life work vehicle, it is necessary that the player of the toy vehicle operate a stick shift and other manual controls analogous to those in a full scale vehicle so that the child can assume the play role of an adult operator.

SUMMARY OF INVENTION

In view of the foregoing, the main object of this invention is to provide a toy work vehicle propelled in either direction by a bi-directional d-c motor and including a power take-off device operated by the same motor, the vehicle having operating controls which simulate the controls on a full-scale vehicle.

More particularly, an object of the invention is to provide a four-wheel drive vehicle of the above type whose wheels are of the tractor type so that the vehicle is capable of traveling over a difficult course and of surmounting obstacles in its path.

Also an object of the invention is to provide manually-operated controls for a vehicle of the above type which includes a multi-position shift stick, each position of which results in a different operation.

A significant advantage of the invention is that it makes available to the young player a control station for the vehicle which affords a broad range of control functions and thereby lends a high level of play value to the toy, the control station also teaching the player how to manipulate and coordinate a relatively complex set of controls.

Briefly stated, these objects are attained in a toy work vehicle in a forward or reverse direction depending on the polarity of battery voltage applied thereto, the vehicle including a power take-off device driven by the same motor to raise or lower a load. A gear shift mechanism operatively coupled either to the wheel axles or to the power take-off device, is controlled by a shift stick which in neutral operatively couples the motor only to the power take-off device. The shift stick is movable to a lateral position having a forward and a reverse mode in which the motor is operatively coupled to the wheel axles. The shift stick also cooperates with a slide carrying the movable contacts of a polarity-reversing switch connecting the battery to the motor such that when the stick is in neutral the motor is disconnected; when the stick is in the forward mode, the battery voltage is applied in a polarity causing forward motion of the wheels; and when the stick is in the reverse mode, the polarity is reversed to cause reverse wheel motion. Coacting with the switch slide is a power take-off lever having a forward and back position such that when the shift stick is in neutral and the lever is in its forward mode, this causes the motor to drive the power take-off device to raise the load, and when the shift stick is in neutral and the lever is in its back mode, this causes the device to lower the load.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

The Mechanical System

Figure 1:
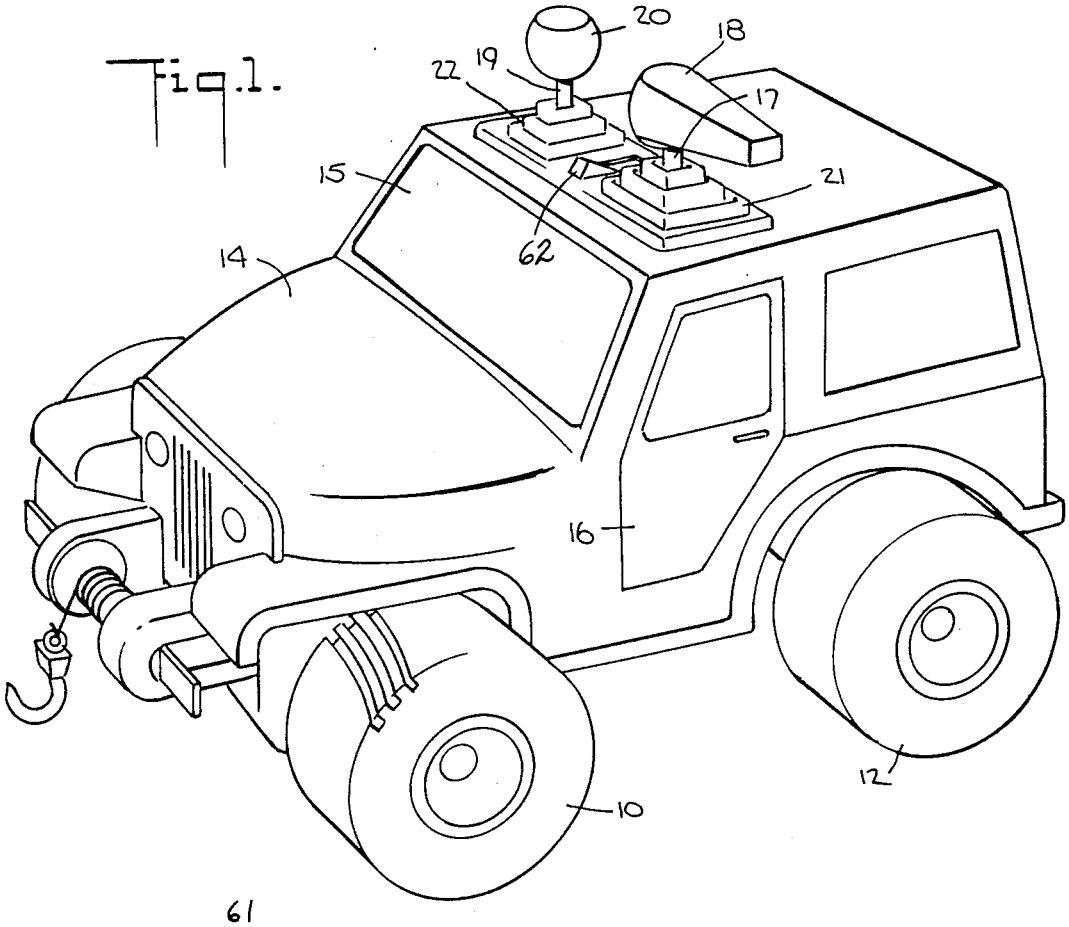
FIG. 1 is a perspective view of a toy work vehicle in accordance with the invention.
Figure 2:
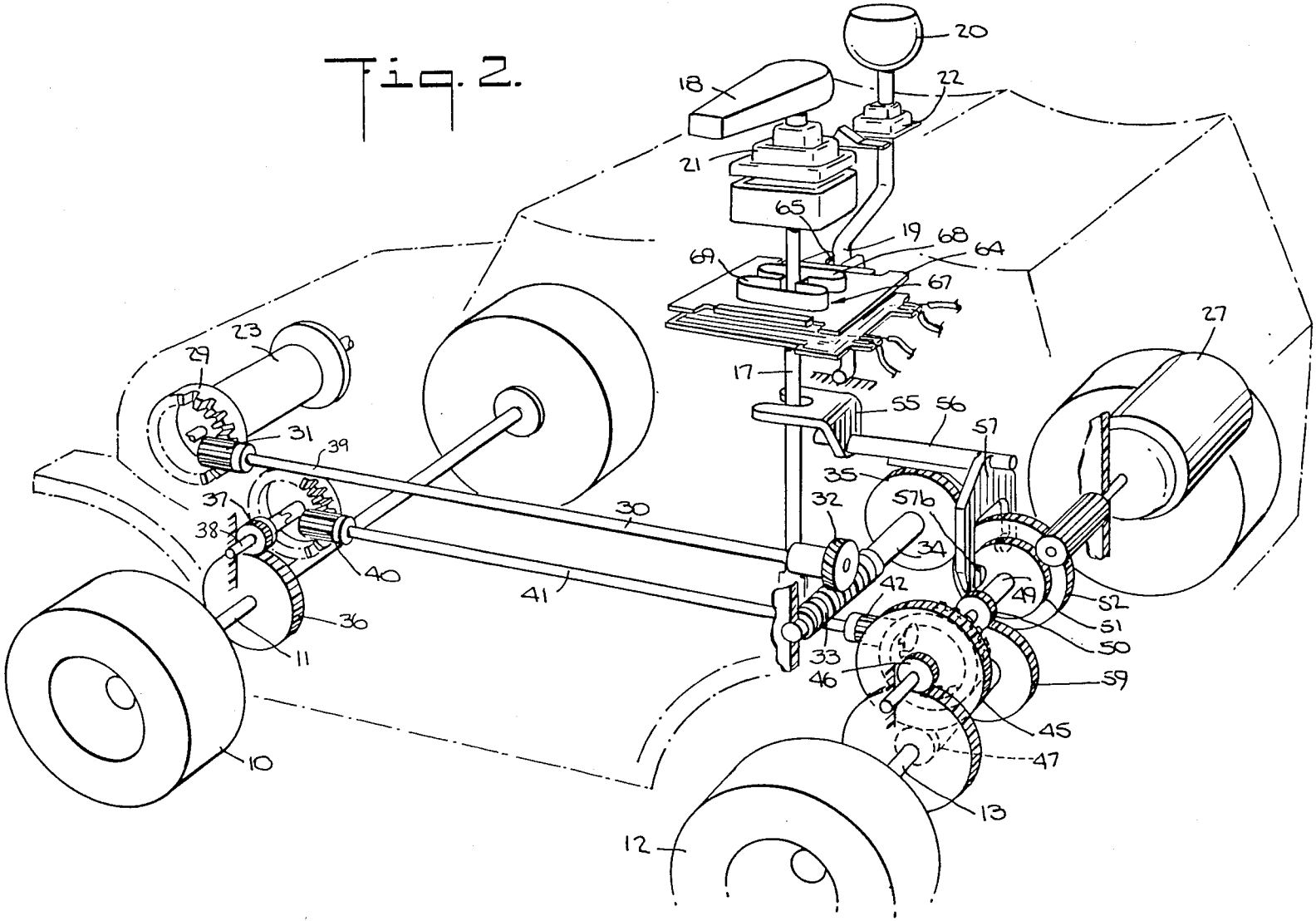
FIG. 2 is a view of the same vehicle with the body in phantom to expose the internal mechanism.

Referring now to FIGS. 1 and 2, there is shown a toy work vehicle in accordance with the invention having a pair of front wheels 10 mounted on opposite ends of a front axle 11, and a pair of rear wheels 12 mounted on opposite ends of a rear axle 13. The wheels are of the tractor type having heavy treads. Supported on the chassis of the vehicle is a body 14 having a windshield 15 and side doors 16.

The control station for the vehicle is on the roof of the body and is constituted by a five-position shift stick 17 having a handle 18, and a power take-off lever 19 having a handle 20. The portion of stick 17 projecting above the roof is shielded by a flexible shroud 21, and the projecting portion of lever 19 is shielded by a flexible shroud 22.

Projecting from the front end of the vehicle is a winch 23 on which is wound a cable 24 terminating in a hook 25. The winch is powered from the same motor which drives the wheels and therefore constitutes the power take-off of the vehicle. This winch can be used to pull or to raise and lower a load as in a conventional work vehicle. The winch represents only one possible form of power take-off. In practice, in lieu of a winch, the vehicle may include a crane or hoist for raising or lowering a load. The gear mechanism shown for rotating the winch can obviously be used to drive other forms of power take-off devices.

Figure 3:
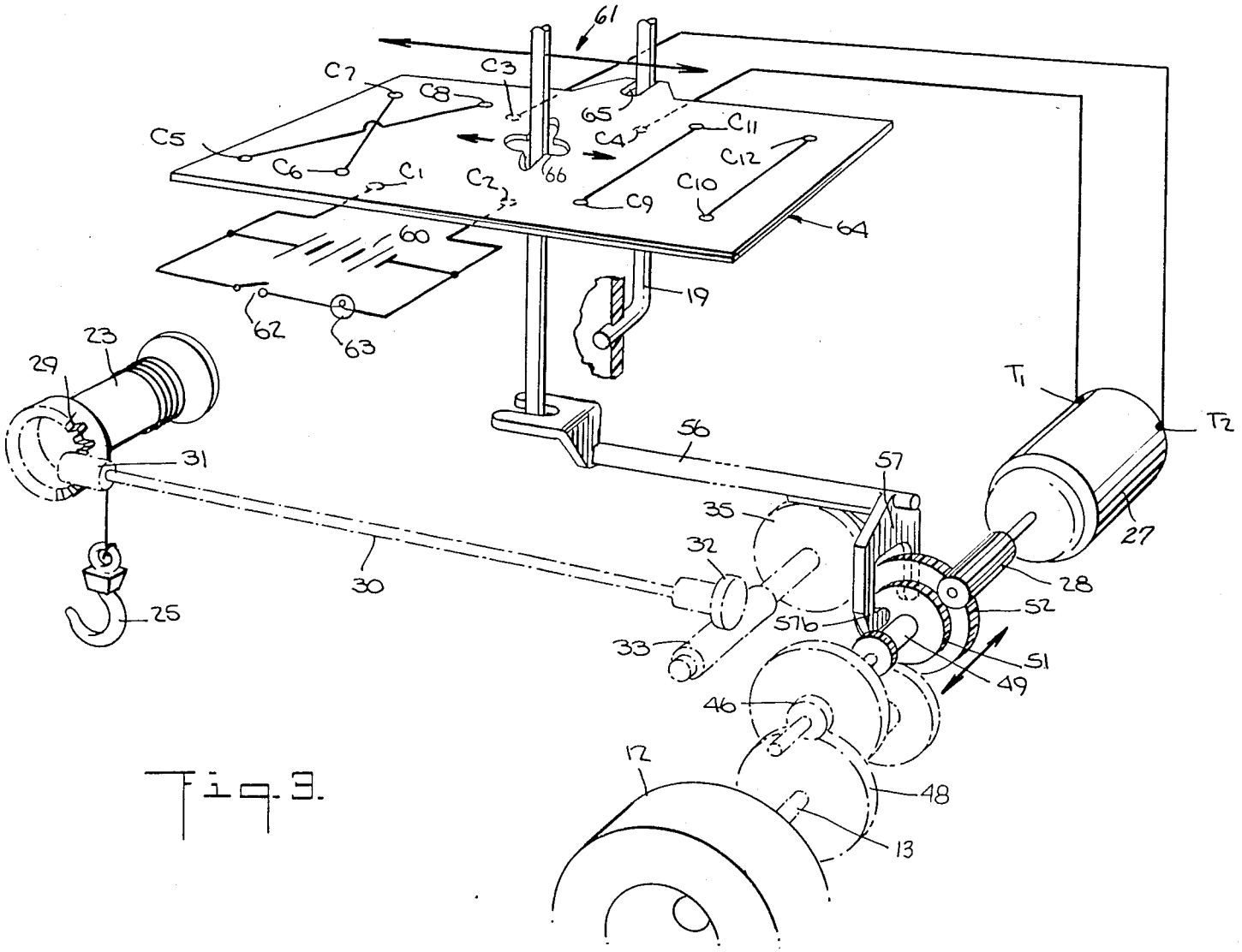
FIG. 3 illustrates in perspective the polarity-reversing switch associated with the motor of the vehicle.
Figure 4:
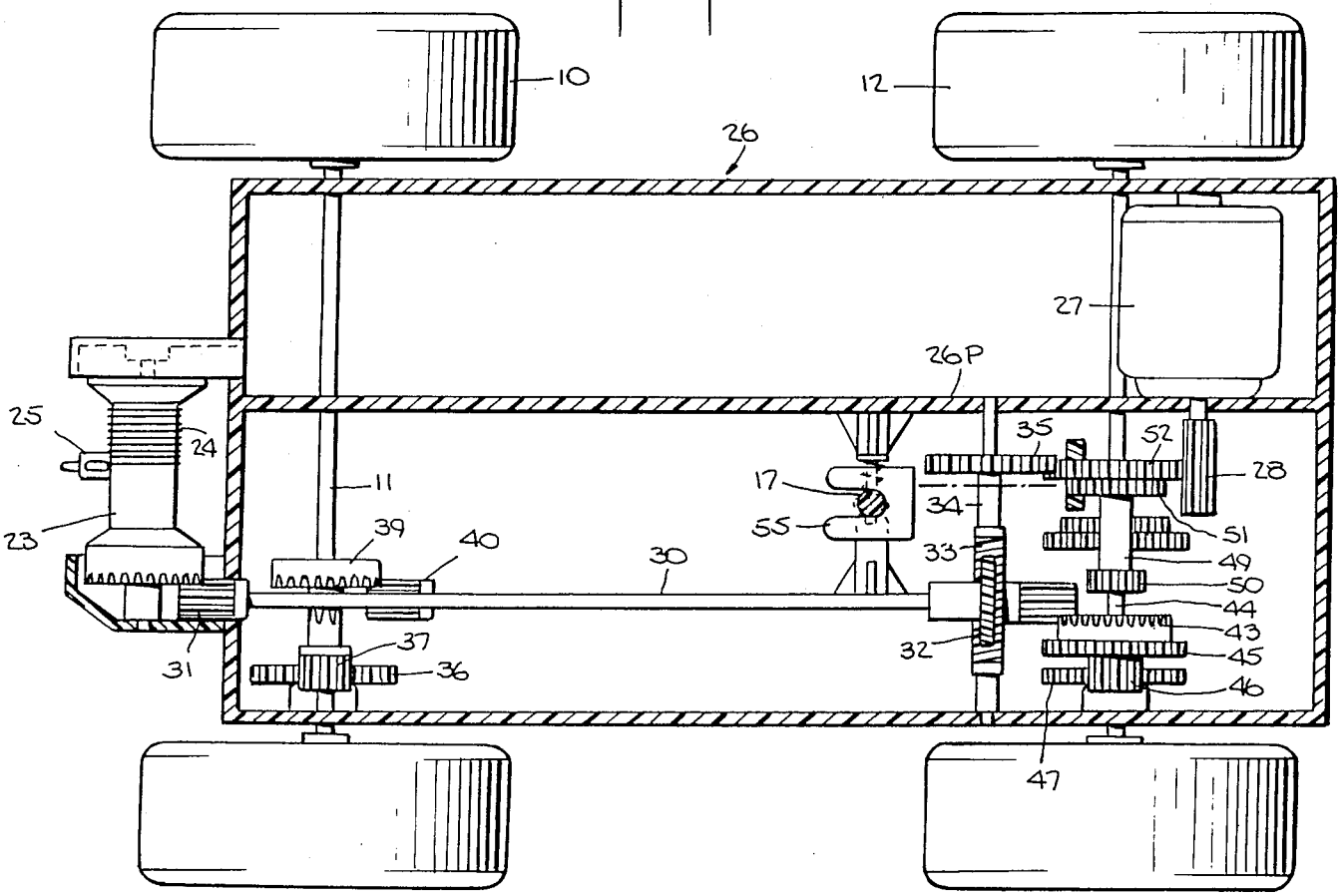
FIG. 4 is a cross-section of the vehicle chassis and the mechanism supported thereby.

As shown in FIGS. 2, 3 and 4, supported within a compartment in the rectangular chassis 26 defined by a partition wall 26P at a position adjacent one of the rear wheels 12 is a bi-directional direct-current motor 27 on whose shaft is keyed an elongated main drive gear 28.

A face gear 29 formed on one end of winch 23 is engaged by a pinion 31 formed one end of a power transmission shaft 30. The other end of this shaft carries a gear 32 that engages a worm gear 33 supported on a short axle 34 at right angles to power transmission shaft 30. Mounted on the end of axle 34 is a power input gear 35 which when driven by the motor transmits power to the winch.

Supported on front wheel axle 11 is an axle gear 36 which is enaged by a pinion 37 carried by a parallel auxiliary axle 38 which terminates in a face gear 39. A gear 40 mounted at one end of a front wheel drive transmission shaft 41 engages face gear 39, the other end of this shaft terminating in a front wheel drive input gear 42.

As best seen in FIGS. 2 and 4, front wheel drive input gear 42 engages the face gear section 43 of a gear assembly mounted on an auxiliary axle 44 parallel to the rear wheel axle 13, the assembly further including a major gear section 45 and a minor gear section 46. The major gear section 45 engages a pinion 47 on the rear wheel axle 13 and the minor gear section 46 engages a large gear 48 on this shaft. Thus when auxiliary shaft 44 turns, this acts to turn both the front and rear wheel axles.

Figure 6:
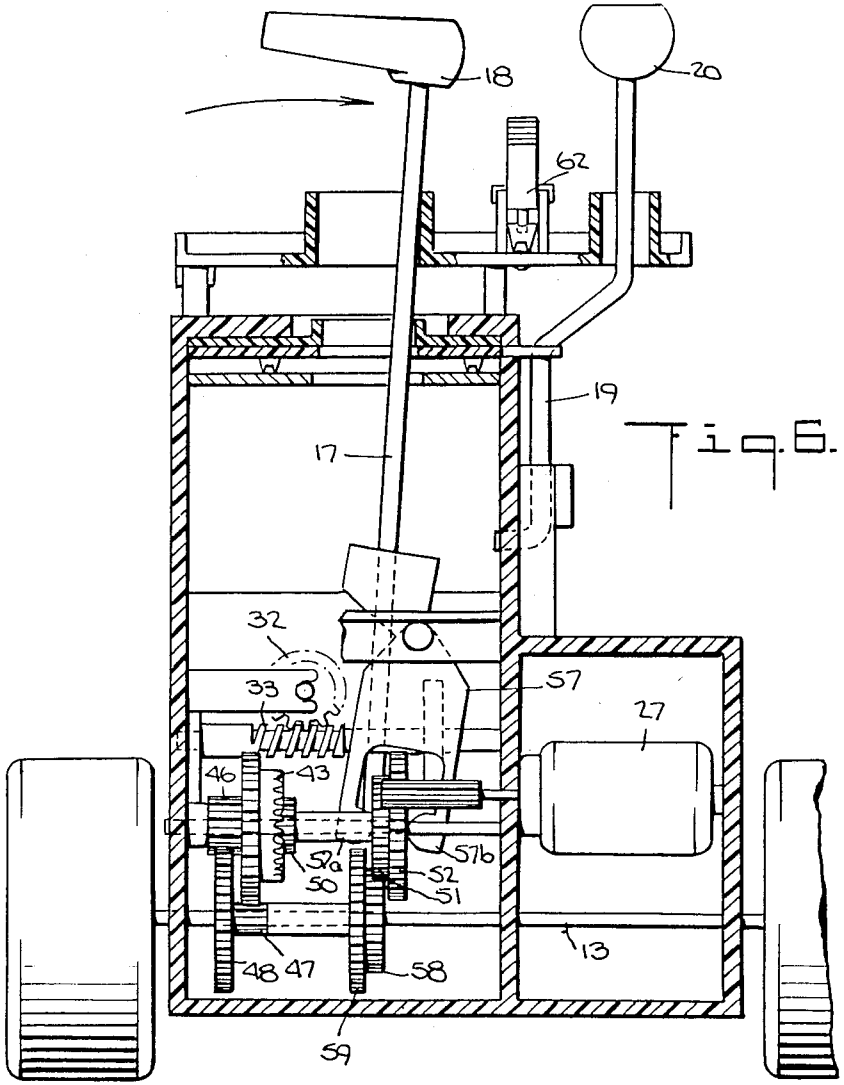
FIG. 6 is the same as FIG. 5, but with the shift stick shown in its high-speed operative position to couple the motor to the gear train for the wheels.
Figure 5:
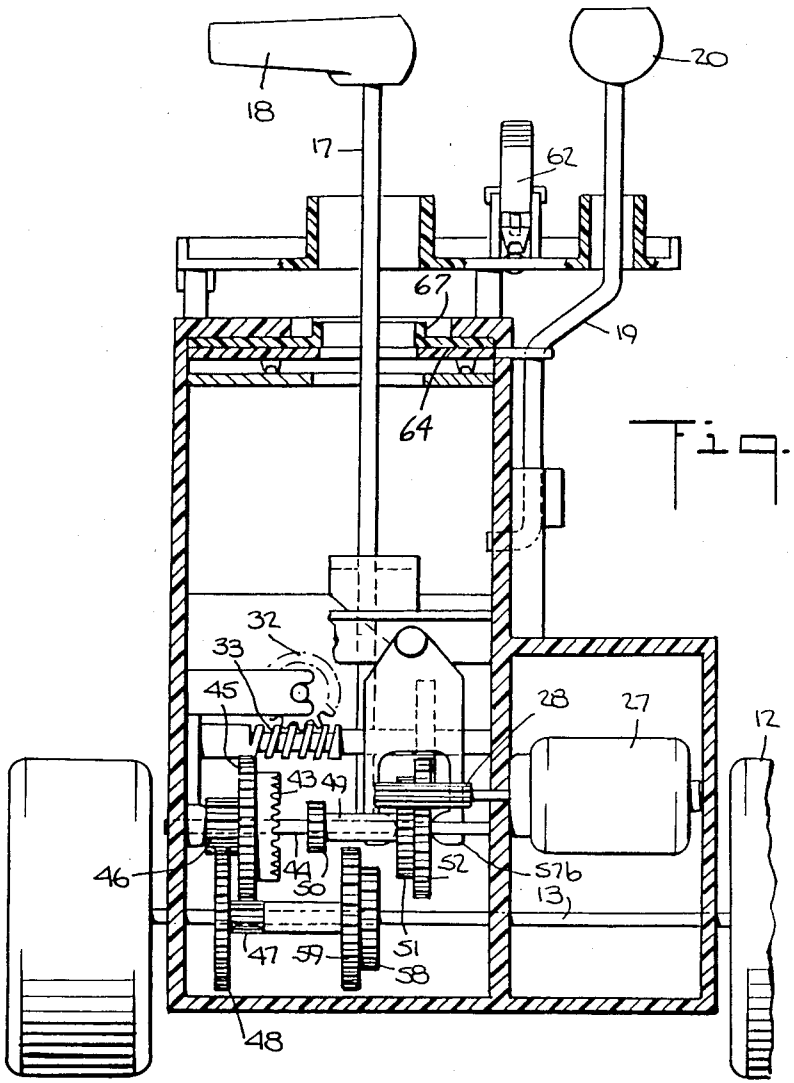
FIG. 5 is a transverse section taken through the vehicle in the vertical plane extending through the manual control station, with the shift stick shown in its neutral position.
Figure 7:
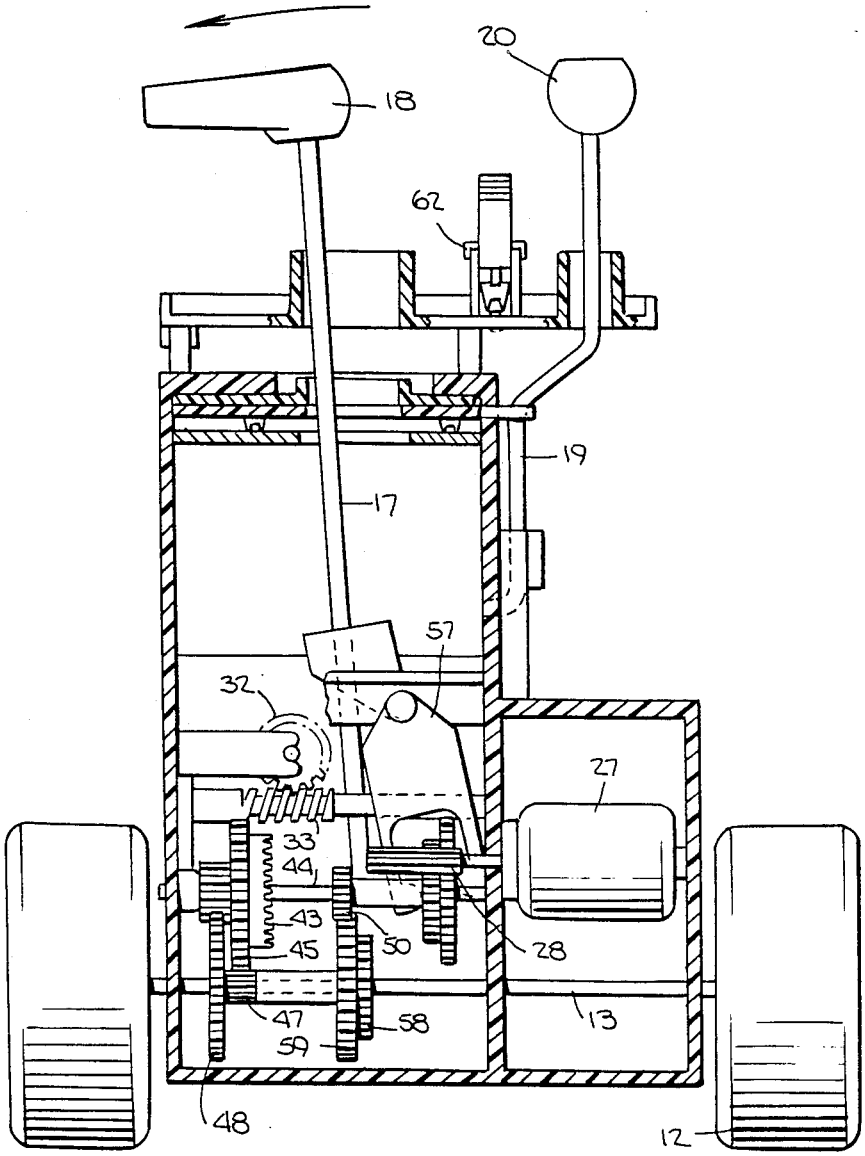
FIG. 7 is the same as FIG. 5, but with the shift stick shown in its low-speed operative position.

Slideably mounted on auxiliary shaft 44, as best seen in FIGS. 5, 6 and 7, is a gear shift assembly constituted by a sleeve 49, which at one end carries a small gear 50 and at the other end both an intermediate size gear 51 and a large gear 52.

Figure 8:
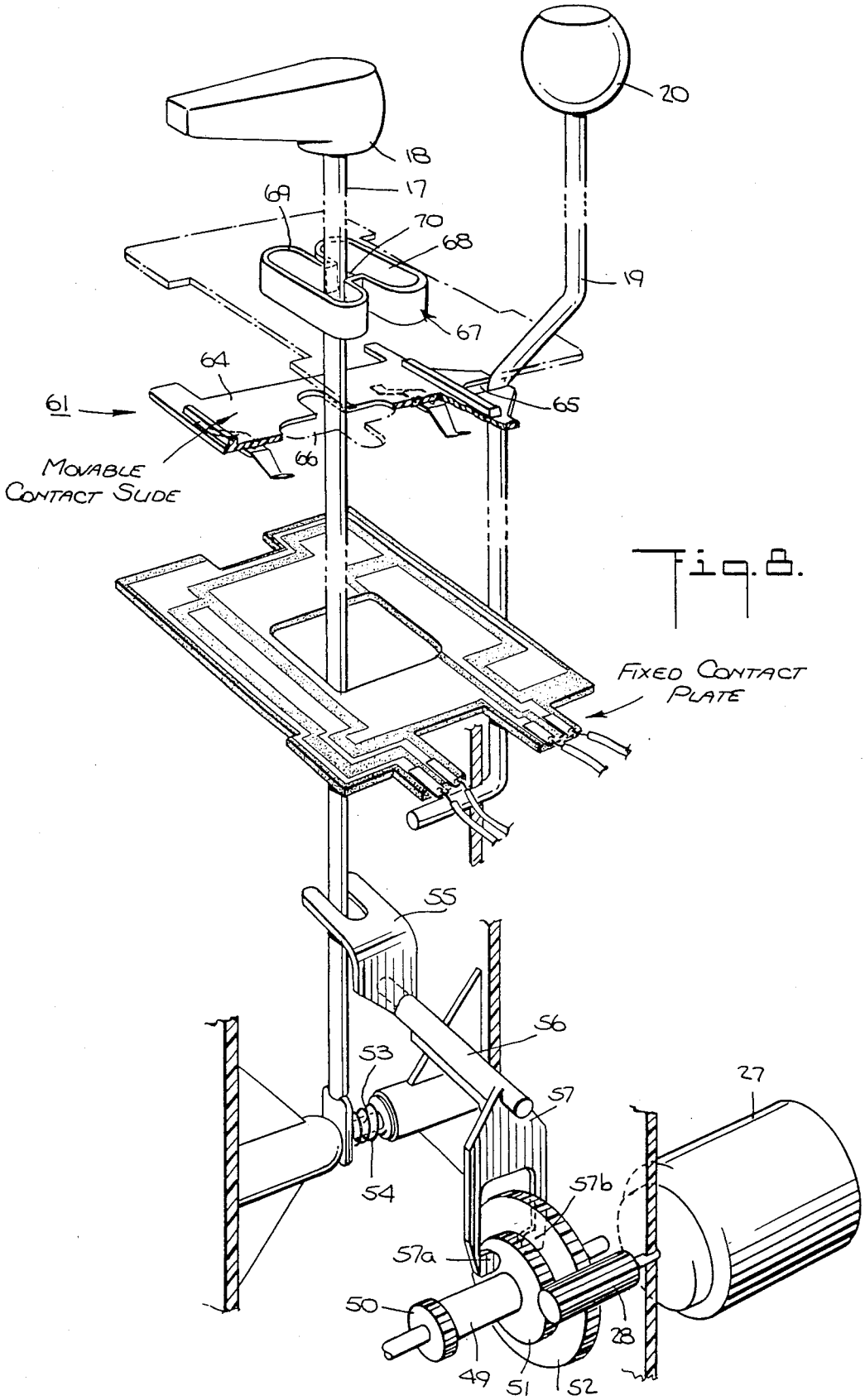
FIG. 8 is an enlarged view of the manual control station.

The gear shift assembly is shiftable on auxiliary shaft 44 to the left or right of its neutral position by means of shift stick 17. As best seen in FIG. 8, stick 17 is pivoted at its lower end on a reduced diameter portion of rod 53, the pivot being biased by a helical spring 54.

Stick 17 is engaged by a yoke 55 mounted on one end of a horizontal crank arm 56 whose other end has a downwardly-extending fork 57 attached thereto. The intermediate and large gears 51 and 52 of the gear shift assembly are positioned between the tines 57*a* and 57*b* of this fork.

When the shift stick 17 is in its neutral position, as shown in FIG. 5, the main drive gear 28 of motor 27 engages the large gear 52 of the gear shift assembly to turn this assembly on auxiliary shaft 44, but the small gear 50 and the intermediate gear 51 then do not engage any gear on the rear wheel axle 13; hence the wheels do not then turn. However, in the neutral position of shift stick 17 the large gear 52 of the gear shift assembly, as shown in FIGS. 3 and 4, does engage the input gear 35 of the power take-off device for winch 23, so that when the shift stick is in neutral the motor cannot then drive the wheels of the vehicle but it can operate the power take-off device.

When the shift stick 17 is shifted toward the right, as shown in FIG. 6, this movement causes fork 57 to shift the gear shift assembly toward the left. As a consequence, the large gear 52 will disengage from the power input gear 35. Hence the power take-off device can only be operated when the vehicle is not moving. With the gear shift assembly shifted toward the left, its small gear 50 remains disengaged while intermediate gear 51 engages an intermediate gear 58 mounted on the rear wheel axle 13 to drive the wheel at a relatively high speed that depends on the gear ratio.

When, as shown in FIG. 7, the shift stick 17 is shifted toward the left to cause the gear shift gear assembly to shift toward the right, then small gear 50 in the assembly engages a large gear 59 on the rear wheel axle 13 to provide low speed operation of the vehicle.

Thus the gear shift arrangement is such that in neutral, motor 27 is operatively coupled through the large gear 52 of the gear shift assembly to the input gear 35 of the power take-off device, the wheels of the vehicle then being decoupled from the motor. When the shift stick is in its right lateral position, the wheels are operatively coupled to the motor through a high speed gear train, and when the stick is in its left lateral position, the wheels are operatively coupled to the motor through a low speed gear train.

The Electrical System

Referring now to FIG. 3, the electrical system associated with bi-directional motor 27 is made up of a battery 60 connected to the motor through a polarity-reversing switch, generally designated by numeral 61. Connected across battery 60 through an on-off switch 62 is a light bulb 63. Switch 62 is located on the control station above the roof of the vehicle (see FIG. 1) between the shift stick 17 and the power take-off lever 19, the light bulb controlled thereby serving as the light source for a pair of headlights formed by a molded light conducting acrylic plate.

Polarity-reversing switch 61 includes two pairs of fixed contacts at the corners of a rectangle, the first pair $C_1$–$C_2$ being connected to battery 60; the second pair $C_3$–$C_4$ to the motor terminals $T_1$ and $T_2$. These fixed contacts cooperate with a movable component in the form of a slide 64 of insulating material which is shiftable in either direction with respect to the fixed contact rectangle. The slide is shown in FIG. 3 in its neutral position in which the midline of the slide is equidistant from the fixed contacts on either side thereof.

Slide 64 carries two sets of contact pairs on either side of its midline. One set is composed of contact pairs $C_5$–$C_5$ and $C_7$–$C_8$ at the corners of a rectangle corresponding to the fixed contact rectangle, the other set being similarly composed of contact pairs $C_9$–$C_{10}$ and $C_{11}$–$C_{12}$.

In the first set of contact pairs on slide 61, contact $C_5$ of one pair is connected to contact $C_8$ of the other pair, while contact $C_6$ is connected to contact $C_7$, so that these pairs are cross connected. In the second set, contact $C_9$ of one pair is connected to contact $C_{11}$ of the other pair and contact $C_{10}$ is connected to contact $C_{12}$, so that the pairs in this set are in parallel relation.

The relationship of stick 17 and of lever 19 to the slide is such that either control element is capable of shifting the slide to the left or to the right. When the slide is shifted to the right, fixed contacts $C_1$ and $C_2$ are engaged by slide contacts $C_5$ and $C_6$, and fixed contacts $C_3$ and $C_4$ are engaged by slide contacts $C_7$ and $C_8$, respectively. Hence the "+" terminal of battery 60 is applied to input terminal $T_2$ of motor 27 and the "−" terminal of the battery is applied to input terminal $T_1$, causing the motor to run counterclockwise.

When the slide is shifted to the left, fixed contacts $C_1$ and $C_2$ are engaged by slide contacts $C_9$ and $C_{10}$, and fixed contacts $C_3$ and $C_4$ by slide contacts $C_{11}$ and $C_{12}$, thereby applying the "+" terminal of the battery to motor terminal $T_1$ and the "−" terminal to motor terminal $T_2$, causing the motor to turn clockwise.

Cooperation between Mechanical and Electrical Systems

Referring now to FIG. 8, it will be seen that slide 64 is provided at one side with a notch 65 which accommodates power take-off lever 19. It will also be seen that at the center of the slide plate is a cruciform slot 66 through which shift stick 17 extends.

The movement of shift stick 17 is confined by a fixed template 67 having a figure of eight configuration to define a walled right slide slot 68 whose position is at right angles to the right transverse arm of the cruciform slot 66, a walled left side slot 69 whose position is at right angles to the left transverse arm of the cruciform slot 66, and a walled cross slot 70 which joins the right and left side slots at their midpoint.

The shift stick 17, at its neutral position, lies within cross slot 70 of the template. In this confined position, the shift stick cannot be shifted forward or back but only sideways. As pointed out previously, when the shift stick is in neutral, motor 27 is then coupled to the input gear 35 (see FIG. 2) of the power take-off device. When, therefore, the shift stick is in neutral, one can only move the slide plate 64 by means of power take-off lever 19. When this lever is pushed forward, the slide is likewise shifted and the motor is operated in one direction. And when the lever is pushed back to shift the slide in the same direction, the motor is operated in the reverse direction.

Figure 11:
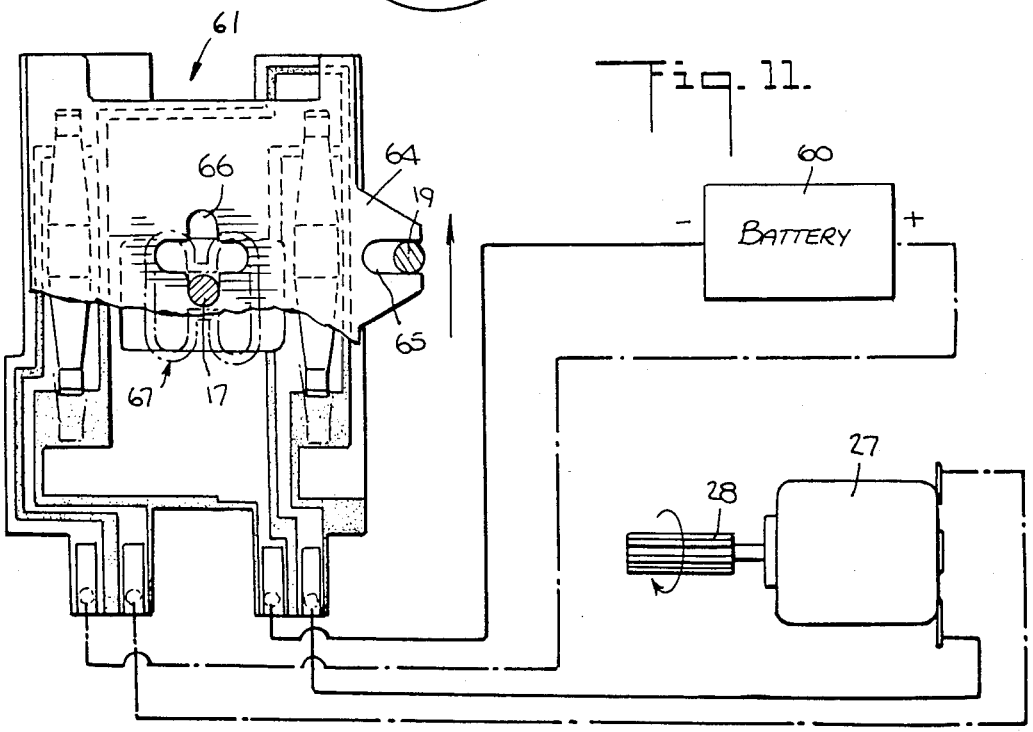
FIG. 11 shows the slide position at an operative position of the power take-off lever which results in clockwise rotation of the motor.

One can, therefore, with the shift stick in neutral, as shown in FIG. 11, then by means of power take-off lever 19 shifted forward or in reverse, drive the power take-off device and cause it to raise or lower a load while the vehicle is at rest. When the shift stick 17 is displaced laterally from its neutral position, the power take-off train is then disengaged from motor 27 and the operation of power take-off lever 19 then has no effect on the power take-off device.

Figure 9:
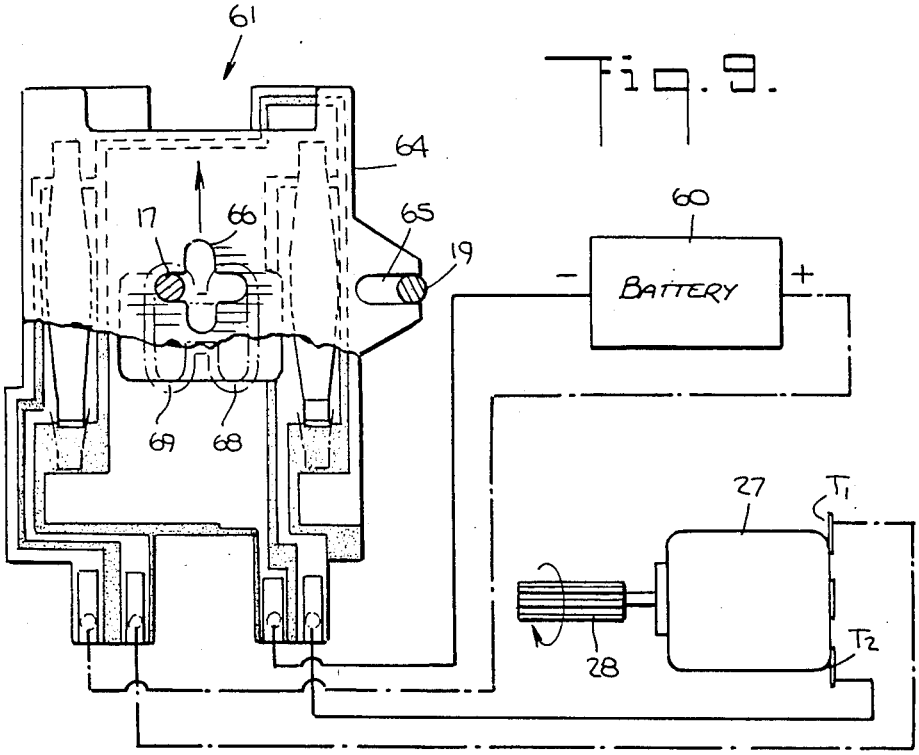
FIG. 9 shows the position of the slide of the polarity-reversing switch at a shift stick position which results in a clockwise motor rotation.
Figure 10:
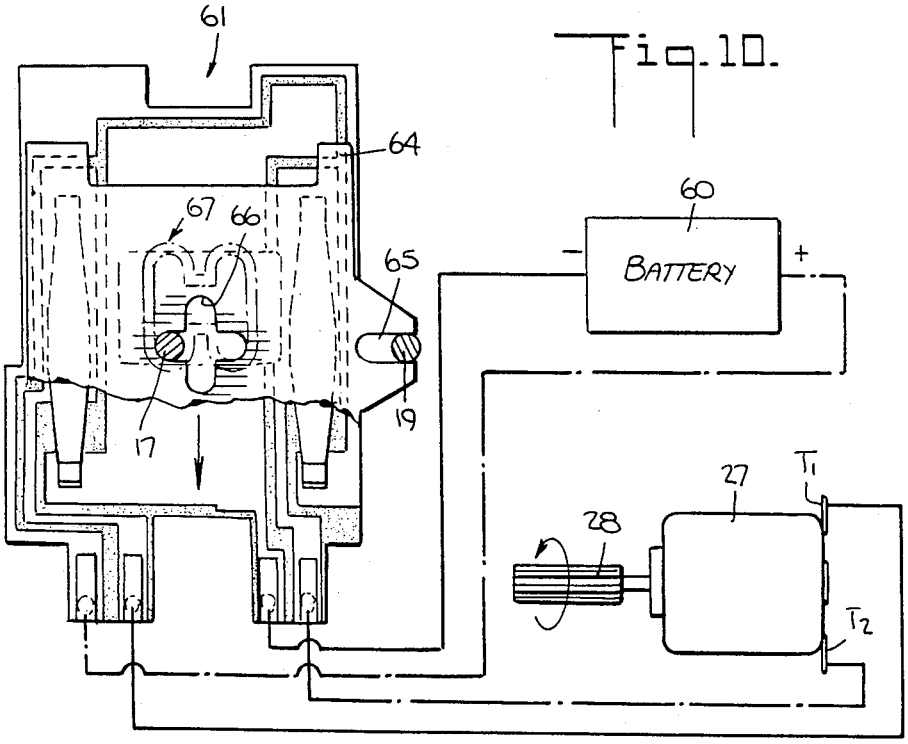
FIG. 10 shows the position of the slide at another shift stick position which results in counterclockwise motor rotation.

The template 67 makes possible a 5-position shift stick operation, the first position being neutral when the stick occupies cross slot 70. When stick 17 is shifted to one side into slot 69 of the template and then pushed back, as shown in FIG. 9, to move switch slide 64 to the left, this applies the battery voltage to motor 27 to cause the gear train coupling the motor to the front and rear wheels to drive the wheel at low speed in the reverse mode; and when the shift stick is pushed forward in slot 69, as shown in FIG. 10, the motor then drives the wheels at low speed in the forward direction. Thus, the second and third positions of the shift stick are low-speed forward and reverse in slot 69. When stick 17 is shifted to the other side into slot 68 and moved forward or back into the fourth and fifth positions, the motor then drives the wheels at high speed in forward or reverse.

Thus the player at the control station on top of the work vehicle can switch the headlights on and off, he can operate the power take-off device and also cause the vehicle to travel at low or high speed, in the forward or reverse direction. This broad range of control functions lends a high level of player interest to the toy and also serves to teach the young player how to manipulate and coordinate a relatively complex set of controls.

While there has been shown and described a preferred embodiment of TOY WORK VEHICLE HAVING POWER TAKE-OFF DEVICE in accordance with the invention, it will be appreciated that many changes and modifications may be made therein without, however, departing from the essential spirit thereof.

We claim:

1. A toy vehicle provided with front and rear wheel axles, said vehicle comprising:

A a bi-directional d-c motor mounted on said vehicle powered by a battery through a polarity-reversing switch, said switch including means whereby in one position of the switch the motor is caused to turn in one direction and in another position, it is caused to turn in the reverse direction;

B a power take-off device mounted on said vehicle independent of said front and rear wheel axles to perform a work function, said device including means for active in two directions on objects discrete from said vehicle; and C means mounted on said vehicle operative in one mode to couple said motor to at least one of said axles whereby said vehicle is driven thereby in the forward direction when the switch is in the one position, and in the reverse direction when the switch is in the other position, said means being operative in a second mode in which said motor is coupled to said power take-off device whereby said device is caused to operate in one direction when the switch is in the one position and to operate in the reverse direction when the switch is in the other position.

2. A vehicle as set forth in claim 1, wherein said power take-off device is a winch.

3. A toy vehicle including a chassis with front and rear wheel axles mounted thereon, said vehicle comprising:

A a bi-directional d-c motor mounted on said chassis;

B a polarity-reversing switch mounted on said chassis for connecting a battery to the motor, said switch having a fixed contact member and a contact member movable in relation thereto having a neutral position wherein it disconnects the battery from the motor, a forward position wherein it connects the battery to the motor in a polarity causing it to turn in one direction and a back position wherein it connects the battery to the motor in the reverse polarity, causing it to turn in the opposite direction;

C means mounted on said chassis including a gearshift mechanism and a manual shift stick for controlling said gear shift mechanism to operatively couple the motor to at least one of the wheel axles, said stick being movably mounted on said chassis and having a neutral position in which the motor is decoupled from the axle and a lateral position in which the motor is coupled to the axle, said shift stick being coupled mechanically to the movable contact member of the switch by means such that when the stick is in its lateral position and is shifted forward, it thereby moves the movable contact member to its forward position whereby the motor then rotates in one direction and drives the vehicle in the forward direction, and when the stick is in its lateral position and is shifted back, it thereby moves the movable contact member to its back position, whereby the motor then reverses direction and drives the vehicle in the reverse direction; and D a power take-off device mounted on the chassis having an input gear which is engaged by a gear of the gear shift mechanism when the shift stick is in its neutral position to couple the motor thereto, and a power take-off lever on said chassis for back and forward movement relative thereto and operatively coupled to the movable contact member of the switch, said lever when moved forward, acting to shift the movable contact member to its back position to operate the motor and power take-off device accordingly.

4. A vehicle as set forth in claim 3 wherein said power take-off device includes a face gear that it coupled through a transmission shaft to said input gear.

* * * * *